US005707276A

United States Patent [19]

Holko et al.

[11] Patent Number: 5,707,276

[45] Date of Patent: Jan. 13, 1998

[54] ABRADER WITH INTEGRAL DEPTH CONTROL

[76] Inventors: Kenneth H. Holko, 3620 Ticonderoga St., San Diego, Calif. 92117; Thomas D. Petersen, 9680 Alto Dr., La Mesa, Calif. 91941

[21] Appl. No.: 518,044

[22] Filed: Aug. 22, 1995

[51] Int. Cl.[6] ..... B24B 23/00

[52] U.S. Cl. ..... 451/356; 451/551; 451/344

[58] Field of Search ..... 451/356, 344, 451/540, 551

[56] References Cited

U.S. PATENT DOCUMENTS

| | | | |
|---|---|---|---|
| 3,914,906 | 10/1975 | Barnes | 451/356 |
| 3,953,944 | 5/1976 | Olson | 451/356 |
| 4,128,970 | 12/1978 | Sawrenko | 451/356 |
| 4,707,947 | 11/1987 | Harris | 451/356 |
| 5,022,189 | 6/1991 | Saul | 451/356 |
| 5,038,526 | 8/1991 | Polin et al. | 451/356 |
| 5,135,533 | 8/1992 | Petersen et al. | 606/176 |
| 5,149,597 | 9/1992 | Holko . | |
| 5,209,022 | 5/1993 | McCambridge | 451/356 |
| 5,358,547 | 10/1994 | Holko | 75/254 |

*Primary Examiner*—Eileen Morgan
*Attorney, Agent, or Firm*—John R. Ross

[57] ABSTRACT

An abrader blade with integral depth control wings. The depth control wings which slide on a portion of the material being abraded to limit the depth of abrasion. The cutting surface of the abrasive surgical device is covered with abrading material. In a preferred embodiment tungsten carbide particles are brazed onto the blade substrate with an equal quantity of cobalt phosphorous braizing alloy. In this preferred embodiment an additional coating is added with a braze alloy specially developed for medical cutting. The carbide particles, the cobalt, the phosphorous and metal phosphides formed during the brazing process are all biocompatable. These blades are especially desirable for abrading bone material into particular shapes for interfacing with prosthesis parts. Several specific blades are disclosed.

23 Claims, 2 Drawing Sheets

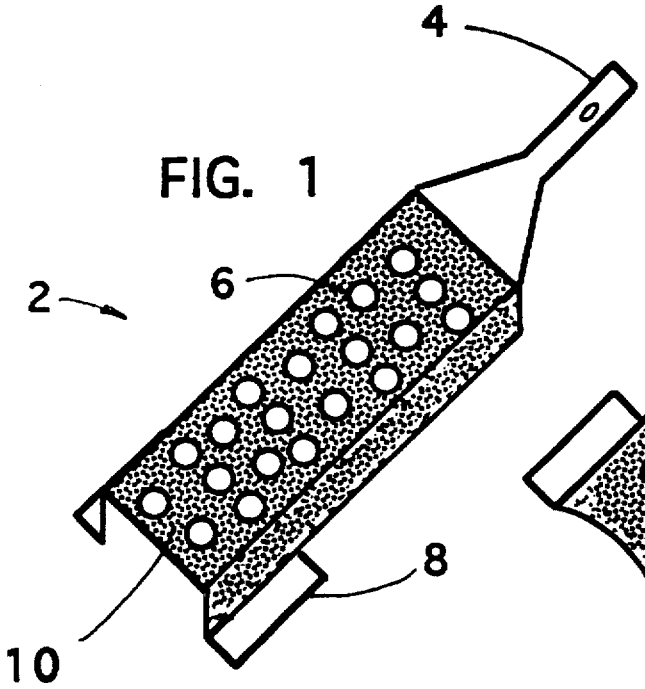
FIG. 1
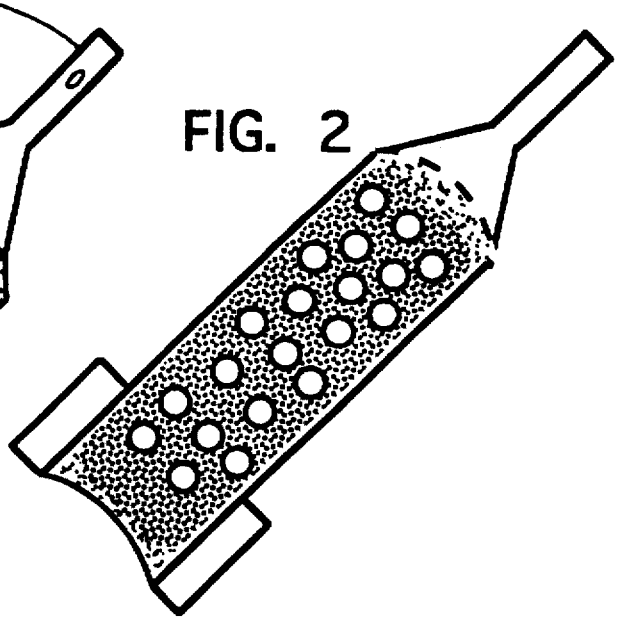
FIG. 2
FIG. 3
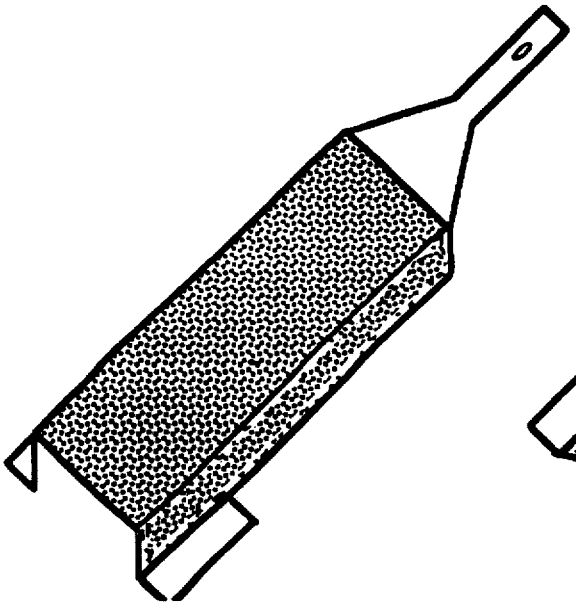
FIG. 4
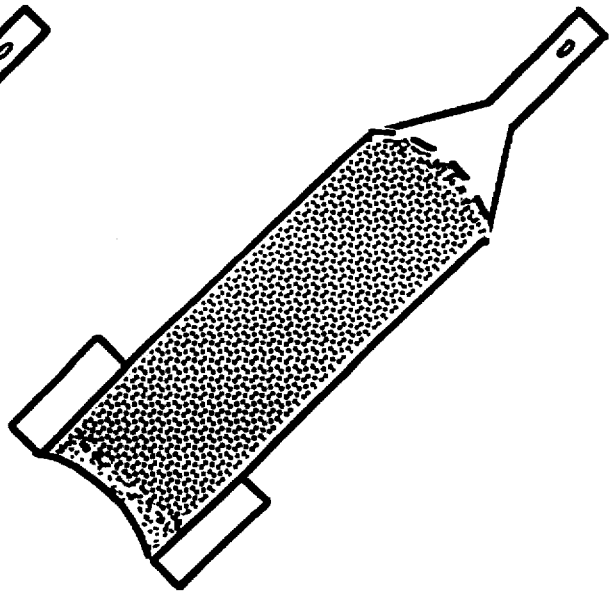

ABRADER WITH INTEGRAL DEPTH CONTROL

This invention relates to surgical devices and especially to abrasive surgical devices.

BACKGROUND OF THE INVENTION

In U.S. Pat. No. 5,135,533 issued to Applicants on Aug. 4, 1992 and in U.S. Pat. No. 5,358,547 issued to Applicant Holko on Oct. 25, 1994, Applicants discuss reciprocating surgical blades and coatings. The teachings of these patents are incorporated herein by reference. Some of the blades disclosed are novel coated gall-resistant surgical saw blades. The blades described comprised a shank designed to be used to couple the blade to the chuck of a reciprocating saw. The blade of a preferred embodiment had special teeth and the blade was guided through a guide slot. Passages were provided for the passage of water for cooling and flushing. Special coatings for the blades were also disclosed in the specification of these patents and the process for applying the coating was described in detail.

During the abrasion of bone tissue minute wear particles that may contaminate vital tissue are a concern and it is important that if these particles are produced that they be biocompatable.

SUMMARY OF THE INVENTION

The present invention provides an abrader blade with integral depth control wings. The depth control wings slide on a portion of the material being abraded to limit the depth of abrasion. The cutting surface of the abrasive surgical device is covered with abrading material. In a preferred embodiment tungsten carbide particles are brazed onto the blade substrate with an equal quantity of cobalt phosphorous brazing alloy. In this preferred embodiment an additional coating is added with a braze alloy specially developed for medical cutting. The carbide particles, the cobalt, the phosphorous and metal phosphides formed during the brazing process are all biocompatable. These blades are especially desirable for abrading bone material into particular shapes for interfacing with prostheses parts. Several specific blades and several examples of biocompatable particles are disclosed.

BRIEF DESCRIPTION OF THE DRAWINGS

FIGS. 1 through 8 are drawings of eight preferred embodiments of the present invention.

DETAILED DESCRIPTION OF PREFERRED EMBODIMENTS

Figure 5:
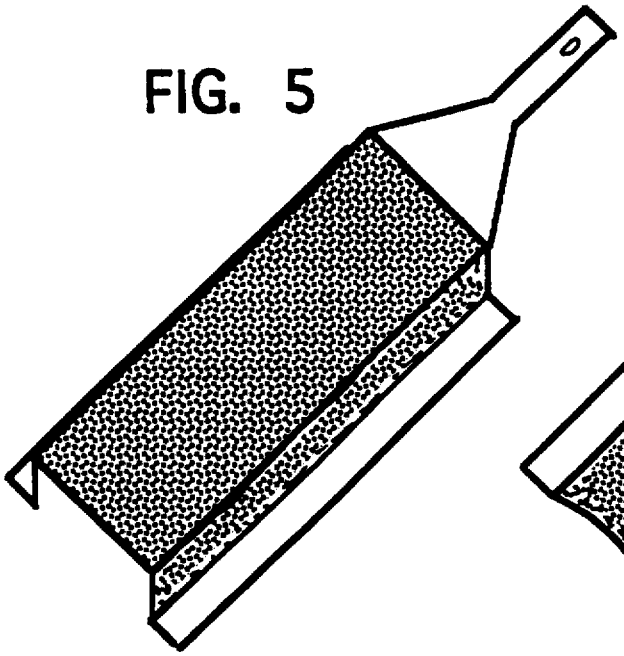

The present invention may be described by reference to the drawings.

Perforated Abrader Blades

FIG. 1 is a drawing of a preferred abrader blade. The blade 2 comprises a shank 4 designed to be used to couple the blade to the chuck of a reciprocating tool (not shown). Typically the reciprocating tool is a tool referred to as a handpiece. The direction of reciprocation is hereinafter referred to as the abrasion direction. The total length of the blade is 3.5 inches in the abrasion direction. It is about 0.04 inches thick (not counting the thickness of abrading material). The shank portion is 0.240 inch wide and its thickness may be varied to fit the available drive or handpiece. The base metal of the blade is stainless steel and it is formed into the shape shown in FIG. 1 with a simple stamping process. This particular blade has about 20 3/32 inch diameter perforations 6 as shown. Perforations are provided to facilitate abraded material removal, improve filing efficiency, provide instantaneous feedback on the rate of material removal and allow circulation of irrigation or lubrication to the abraded surface. This particular blade also has wing elements 8 which are kept smooth and serve to prevent the box-shaped groove that is cut by the blade from being any deeper than about ¼th inch. Wings may be positioned so as to provide box-shaped groove cuts of a wide variety of depths. For this blade surface 10 is coated by attaching macrocrystalline, tungsten carbide particles with a special brazing alloy which not only brazes the tungsten carbide particles to the blade surface but also provides a very fine biologically compatible coating to the particles. Our preferred coatings and brazing process are described below.

Brazing Process

An excellent brazing process for attaching the tungsten carbide particles to the base metal of the blade is a process which is described in detail in Holko U.S. Pat. No. 5,358,547, issued on Oct. 25, 1994. The text of that patent is incorporated by reference herein; however, we will summarize some of the important steps of that process. The alloys identified in Table B by the numbers 4–15 are suitable for use in providing abrasive surfaces for file blades. Of this group we have had very good results with the following compositions:

Alloy No. 4: 75 to 90% CoP and 10 to 25% Nicrobraz 50,
Alloy No. 7: 75% CoP and 25% Nicrobraz 135,
Alloy No. 9: 75% CoP and 25% Amdry 100,
60% Alloy No. 4 plus 40% Amdry 100,
60% Alloy No 7 plus 40% Amdry 100, and
55% Nicrobraz 50 plus 45% Nicrobraz 135.

Abrasive surfaces needed for our abraders are generated by brazing discrete particles to the substrate surface. The particles may be produced by atomizing or crushing from a solidified melt, as explained in the patent. Particles may also be produced by cutting or chopping various shapes such as wire with various cross-sectional geometries. One preferred particle-alloy combination is given by alloy Number 13 which is 50% Co P and 50% tungsten carbide and applied with and overcoating of CoP. This particle-alloy combination 13 is especially hard due to the incorporation of tungsten carbide. In this example, "CoP" alloy was employed in equal amounts by weight, with Tungsten Carbide and applied with a commercially available binder such as Nicrobraz to the surface of a file blade. After application, an overcoating of "CoP" was provided. The file blade was heated to a temperature of 1975 degrees F., for 15 minutes in a vacuum furnace. The procedure was then repeated to improve bonding.

In another preferred application, Alloy 15 (50% CoP and 50% T-400 Powder) is applied but in a coarse mesh size (circa 20 to 50 mesh) and is intentionally left separated to provide a highly abrasive surface. This type of powder has less tendency to undergo particle fracture, a property which is common with harder but more brittle particles such as those formed of diamond and carbides. This is due to the presence of Tribaloy-400 which comprises a Cobalt base material generally used for plasma spraying in fine mesh size to develop a wear resistant surface.

Tungsten carbide, combinations of tungsten carbide and other carbides such as titanium carbide or other, biocompatible carbides may be used. The carbides may be used in pure or crystalline form or may be combined with a binding agent such as nickel or cobalt. The carbides may be prior coated, as with nickel for an example. The carbides may be selected with various mesh size ranges so that abraders with various "aggressiveness" are provided. Other abrasive particles such as nitrides and silicides may be used. Also, stainless steel particles or other alloy particles may be used with different degrees of angularity produced by cutting various shapes such as wire with various cross-sectional geometries.

The brazing and coating material may be CoP and any combination of other materials listed in Table A and B of U.S. Pat. No. 5,358,547. The brazing material may be first applied to the substrates with a suitable, volatile binder, followed by application of the carbide particles; or the brazing material and the abrasive particles may be premixed before application with a suitable binder. The coated abrader may be fired in a vacuum furnace with suitable tooling at this point or additional braze alloy may be added before firing. In either case, after the first firing, a second coating of the abrasive particles is done with the same brazing materials which now complete the bonding of the abrasive particles to the substrate and coat the particles for biocompatibility, wear resistance, and improved particle lubricity as described. This is done in a second vacuum furnace firing.

Other Medical Cutting Devices

Figure 6:
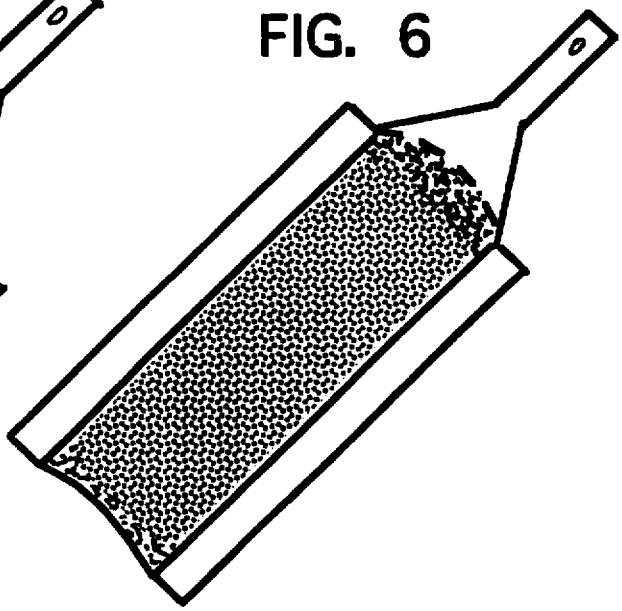
Figure 7:
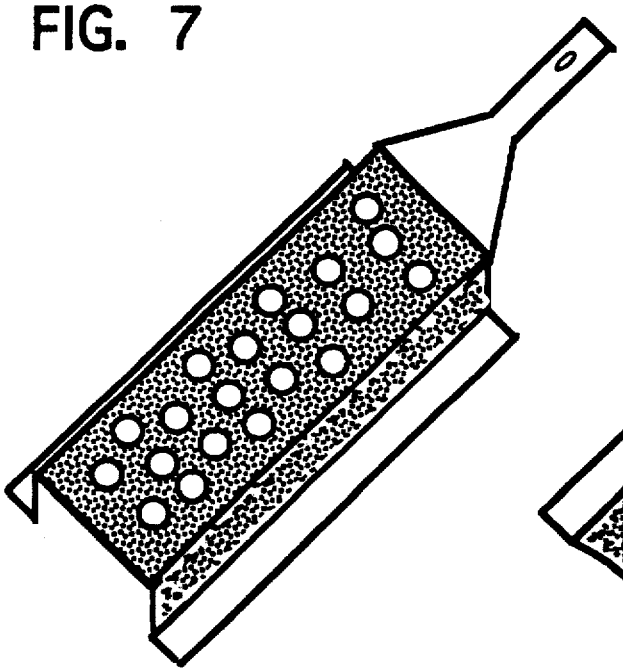
Figure 8:
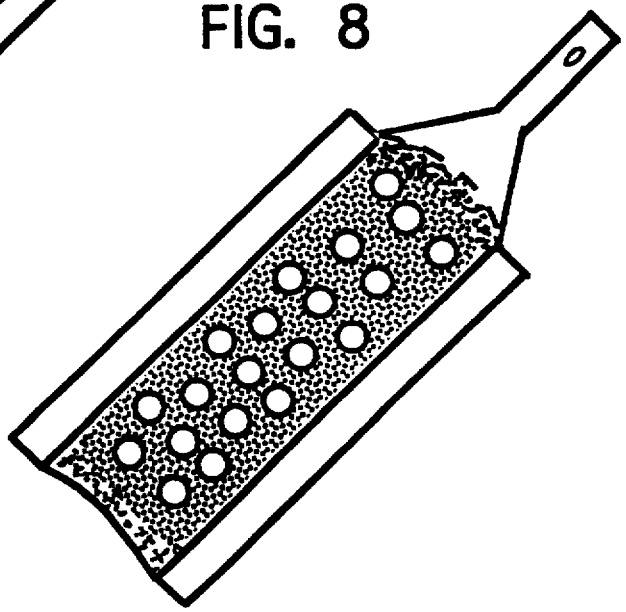

FIGS. 2 through 8 describe respectively: a curved abrader with perforations and short slide wings; a box abrader with no perforations and short wings; a curved abrader with no perforations and short wings; a box abrader with no perforations and long wings and a curved abrader with no perforations and long wings; a box abrader with perforations and long wings and a curved abrader with perforations and long wings.

While the above embodiments are described in specific detail, persons skilled in the art will recognize many other embodiments are possible using the principals of the present invention. For example, The mechanized and hand operated file blades which are coated in accordance with the teachings of the present invention are normally provided for bone shaping and reduction in orthopedic surgery. In these applications, biocompatibility is quite important and, therefore, a cobalt base brazing alloy utilizing phosphorous for melting point depression is used to join the particles to the substrate surface. As understood from Table B of U.S. Pat. No. 5,358,547, the braze alloy may be combined with other commercially available braze alloys to provide other properties such as increased hardness, fracture resistance and corrosion resistance. Other commercially available braze alloys are chosen for their respective abilities to from phosphides, silicides, borides and carbides on particle surfaces during the brazing process. If desired, the Titanium-Cobalt "eutectic" may also be employed for the brazing alloy. The preferred environment of brazing comprises a vacuum furnace, although inert gas coverage during the heating cycle is also viable.

For various file applications, especially medical applications, the file blade may be provided with numerous perforations other than those shown in the drawings. The perforations may have various shapes and densities and the circular pattern and the number 20 are shown merely as examples. The perforations allow circulation of saline irrigation solution to the abraded surface which is a recommended practice to reduce frictional heating and avoiding thermal necrosis. If desired, perforations may be provided and abrasive particles may be brazed only around the respective peripheries of the perforations so that even more low lying surface area is provided for debris circulation and removal.

The wings of the blades show in the figures are all flat and in the same plane, however, for some special applications it may be desirable for the wings to have a different shape (for example, rounded) or to be located in different planes.

The abraders described above, particularly the box design shown in FIGS. 1, 3, 5 and 7, may also operate in an oscillating motion with an appropriate mechanical drive or handpiece. This is useful for making fine reductions in bone or material height over large, flat surfaces.

Various metallic phosphides are formed on the new surface of the substrate. These phosphides are combinations of cobalt phosphide and other phosphides such as iron phosphide and other metallic phosphides from the substrate and additional coating powder elements. These phosphides are responsible for improved wear resistance and lubricity.

Accordingly, the reader is requested to determine the scope of the invention by the appended claims and their legal equivalents, and not by the examples which have been given.

We claim:

1. An abrader blade, for use with an abrasion tool, for abrading a shape in a hard object, said blade comprising:

1) at least one abrasion surface defining:
   an abrasion direction,
   a long dimension in the direction of said abrasion direction, and
   a short dimension in a direction perpendicular to said abrasion direction, 2) a shank means for coupling said blade to a chuck of a tool, and 3) at least two depth control wings each wing having at least one smooth sliding surface, said at least two wings being positioned on opposite sides of said at least one abrasion surface so as to control the depth of said shape abraded in said hard object.

2. An abrader as in claim 1 wherein said tool is a hand piece.

3. An abrader as in claim 2 wherein said hand piece is a mechanical driven hand piece.

4. An abrader as in claim 3 wherein said mechanical drive hand piece is an electric driven hand piece.

5. An abrader as in claim 3 wherein said mechanical drive hand piece is an pneumatically driven hand piece.

6. An abrader as in claim 2 wherein said hand piece is a manual hand piece.

7. An abrader blade as in claim 1 wherein said abrader blade further comprises perforations.

8. An abrader blade as in claim 1 wherein said abrading surface of said elongated blade is coated with coating comprising a brazing alloy and hard particles.

9. An abrader blade as in claim 8 wherein said brazing alloy comprises cobalt phosphorous and said hard particles comprises tungsten carbide particles.

10. An abrader blade as in claim 8 wherein said coating is covered with a brazing alloy overcoating.

11. An abrader as in claim 10 wherein said overcoating is cobalt phosphorous.

12. An abrader blade as in claim 8 wherein said brazing alloy is selected from the group consisting of:

Alloy No. 4: 75 to 90% CoP and 10 to 25% Nicrobraz 50,
Alloy No. 7: 75% CoP and 25% Nicrobraz 135,
Alloy No. 9: 75% CoP and 25% Amdry 100,
60% Alloy No. 4 plus 40% Amdry 100,
60% Alloy No 7 plus 40% Amdry 100, and
55% Nicrobraz 50 plus 45% Nicrobraz 135.

13. An abrader blade as in claim 12 wherein said abrading surface comprises an overcoating comprising a brazing alloy selected from a group consisting of:

Alloy No. 4: 75 to 90% CoP and 10 to 25% Nicrobraz 50,

Alloy No. 7: 75% CoP and 25% Nicrobraz 135,

Alloy No. 9: 75% CoP and 25% Amdry 100,

60% Alloy No. 4 plus 40% Amdry 100,

60% Alloy No 7 plus 40% Amdry 100, and

55% Nicrobraz 50 plus 45% Nicrobraz 135.

14. An abrader blade as in claim 8 wherein said hard particles are nitride particles.

15. An abrader blade as in claim 8 wherein said hard particles are silicides.

16. An abrader blade as in claim 8 wherein said hard particles are chopped portions of stainless steel wire.

17. An abrader blade as in claim 1 wherein said abrading surface of said blade is coated with coating comprising cobalt phosphorous and Tribaloy 400 powder.

18. An abrader blade as in claim 1 wherein said at least two depth control wings are flat and in a common plane.

19. An abrader blade as in claim 1 wherein said at least two depth control wings have a rounded shape.

20. An abrader blade as in claim 1 wherein said at least two control wings are in a single plane defining a wing plane and said at least one abrasion surface is three abrasion surfaces, each of which surfaces are planar surfaces, one of said three surfaces being in a plane parallel to said wing plane and the other two surfaces each being in planes parallel to said abrasion direction and perpendicular to said wing plane, each of said other two surfaces connecting said first surface to one of said control wings; wherein said abrader is thus shaped to abrade a box-shaped trench defining a depth with said control wings limiting the depth of said box-shaped trench.

21. An abrader blade as in claim 1 wherein said at least two control wings are in a single plane defining a wing plane and said at least one abrasion surface is a surface characterized by rough generally straight lines in the abrasion direction and a generally arc-shaped cross section; wherein said abrader is thus shaped to abrade an arc-shaped trench defining a depth with said control wings limiting the depth of said arc-shaped trench.

22. An abrader blade as in claim 1 wherein said at least two control wings are in a single plane defining a wing plane and said at least one abrasion surface is two abrasion surfaces, each of which abrasion surfaces are planar surfaces said two planer surfaces together forming a V-shaped cross section, each of said two abrasion surfaces connecting to one of said control wings and to the other abrasion surface; wherein said abrader is thus shaped to abrade a V-shaped trench defining a depth with said control wings limiting the depth of said V-shaped trench.

23. An abrader blade as in claim 1 wherein said at least two depth control wings are flat and in different planes.

* * * * *